United States Patent [19]

Eaton

[11] 4,144,477

[45] Mar. 13, 1979

[54] LONG LIFE INCANDESCENT SWITCHING SYSTEM

[75] Inventor: Favre E. Eaton, Winsted, Conn.

[73] Assignee: Combustion Engineering, Inc., Windsor, Conn.

[21] Appl. No.: 815,619

[22] Filed: Jul. 14, 1977

[51] Int. Cl.[2] ..... H05B 39/00

[52] U.S. Cl. ..... 315/276; 315/136; 315/208; 315/282; 323/6; 328/8; 361/2

[58] Field of Search ..... 315/129, 130, 133, 135, 315/136, 205, 208, 246, 254, 257, 276, 278, 282; 328/8, 9; 307/326, 327, 252 UA, 311; 361/2, 112; 330/207 P; 323/6, 9; 340/46

[56] References Cited

U.S. PATENT DOCUMENTS

| | | | |
|---|---|---|---|
| 2,445,088 | 7/1948 | Schilling | 323/6 X |
| 3,524,986 | 8/1970 | Harnden | 250/551 X |
| 3,663,950 | 5/1972 | Bartlett | 307/252 UA X |

*Primary Examiner*—Eugene R. LaRoche

[57] ABSTRACT

A supply and switching system for incandescent indicator lights is disclosed. A solid-state AC switch is used in conjunction with a current-limiting-transformer supply. The use of the current-limiting transformer protects the solid-state switch from the large current transients that are sometimes caused by failures in incandescent bulbs.

3 Claims, 1 Drawing Figure

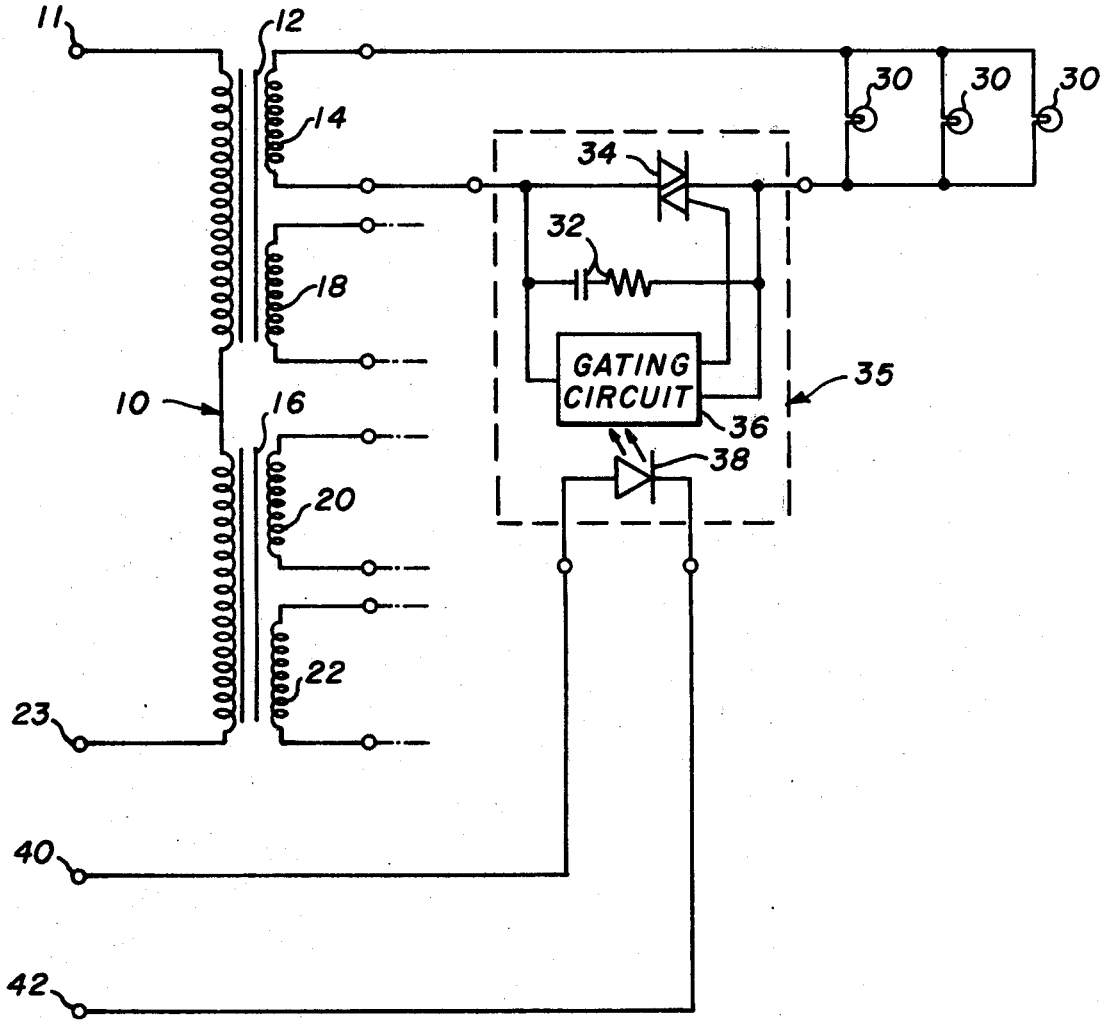
11
12
14
18
10
16
20
22
23
40
42
30
30
30
34
32
GATING CIRCUIT
35
36
38

LONG LIFE INCANDESCENT SWITCHING SYSTEM

BACKGROUND OF THE INVENTION

A high level of reliability is required of indicator lights that are used in nuclear-reactor control panels as well as in many other types of equipment. The extent to which this requirement is fulfilled is affected not only by the bulb itself but also by its electrical environment. Accordingly, the designer should give serious attention to the design of the switching and supply systems that constitute the electrical environment of the bulb.

Among the types of switching and supply systems currently used is the combination of a transformer with a mechanical relay or switch. The transformer supplies AC power, and the relay or switch controls application of the power to the bulb. This combination is simple, and its use of an AC source makes it more merciful to the bulb filament than it would be if it employed a direct-current source. The mechanical relay or switch, however, is relatively large and unreliable in comparison with the solid-state switch. In contrast to a solid-state switch, moreover, a mechanical switch or relay cannot be activated at zero crossings of the AC supply, and this results in an unfavorable effect on bulb longevity.

The solid-state switch also has disadvantages. Solid-state switches fail when subjected to currents that exceed their rated capacities, and such currents may be drawn by incandescent bulbs when they fail short, as they occasionally do. The shorted bulb draws a large current whose magnitude is limited only by line impedances. Therefore, if a solid-state switch has been chosen that has a continuous-current rating not greatly in excess of the normal bulb current, its short-duration current rating may well be exceeded by the current drawn by the shorted bulb. The short-duration current rating of the solid-state switch can also be exceeded when a cold bulb is turned on. Accordingly, in order to avoid damage to the solid-state switch, the designer must choose switches with continuous-current ratings considerably in excess of the normal bulb current. This, of course, increases expense and reduces the advantages that solid-state switches would otherwise have over mechanical switches and relays.

In order to avoid choosing a solid-state switch with a continuous-current rating greatly in excess of the normal current requirement of the bulb that it controls, designers have protected the solid-state switch by providing a fuse in series with it. Fuses provide only limited protection, however, since they cannot always be relied on to blow before the switch has been damaged. In addition, the use of a fuse makes it necessary to replace both the fuse and the bulb if the bulb fails short. Furthermore, when several indicator lights are controlled by the same switch, the use of fuse makes it necessary to change the fuse before the defective bulb can be located.

A supply and switching system that protects solid-state switches without using fuses is the combination of a solid-state switch with a current-limited DC power supply. Though simple in concept, this approach greatly increases the cost in systems in which large numbers of bulbs are to be powered. In addition, this type of system exhibits the unfavorable bulb-longevity characteristics of a DC supply.

It is apparent that the present state of this widely used and well explored art requires the designer to make trade-offs among bulb longevity, circuit reliability, and expense because the art has provided no means for obtaining the optimum in all three.

SUMMARY OF THE INVENTION

Accordingly, the object of the present invention is a switching and supply system that affords increased bulb life, allows the use of solid-state switches, and minimizes supply expense, thereby eliminating the trade-off requirement that has heretofore plagued the art.

According to the present invention a supply and switching system is provided wherein a current-limiting transformer is used to supply power to an incandescent bulb, and the power is controlled by means of a solid-state switch. The current-limiting transformer permits the use of an alternating-current power source and a low-current solid-state switch, thus allowing the cost of a complicated power supply to be avoided while providing the longevity benefits of AC power.

BRIEF DESCRIPTION OF THE DRAWING

These and further features and advantages of the invention become evident in the description of the embodiment shown in the attached drawing, which is a schematic diagram of the preferred embodiment of the invention.

DETAILED DESCRIPTION OF THE PREFERRED EMBODIMENT

The FIGURE illustrates a switching and supply circuit in which bulbs 30 are to be supplied power by current-limiting transformer 10 through switching means 35. Bulbs 30 are illustrated as a plurality of bulbs in parallel, but the invention applies equally to a single bulb. A plurality is shown only because this is typical in the redundant systems often required in nuclear-reactor applications. In fact, the load need not be an incandescent bulb or bulbs; any type of load that is subject to current surges is contemplated by the present invention.

Transformer 10 is illustrated as having two cores 12 and 16, each being magnetically coupled to the primary windings of transformer 10. Core 12 is shown as being coupled to secondary windings 14 and 18, while core 16 is shown coupled to windings 20 and 22. This is thought to be a satisfactory schematic representation of the current-limiting transformer of the preferred embodiment, which has a single primary core section connected magnetically across two separate secondary core sections. It would be more customary to have a single core symbol for such a transformer, but it is important for present purposes to emphasize the independent functioning of the two core sections.

Transformer 10 is a magnetic shunt transformer, a type of transformer that limits the amount of current induced in one or more of its secondaries. An alternate magnetic path is provided in parallel with each of the secondary sections. When a secondary section saturates, as it is designed to do at a predetermined current level, the associated alternate path diverts any additional flux away from the saturated secondary. As can be appreciated, if one secondary section is saturated while the other is not, the current-limiting action will only take place in one secondary section. This is why the secondary sections are shown as being parts of different cores.

Secondary windings 14 are connected at one end to three parallel-connected incandescent bulbs and at the other to solid-state switch 35, which completes the bulb circuit. Solid-state switch 35 can be any one of the many types commercially available. A typical solid-state switch might provide opto-isolation by having the input circuit, terminals 40 and 42 and LED 38, connected only optically to the rest of the switch. Element 36 represents a gating circuit sensitive to light. It gates triac 34 on only when LED 38 is forward biased enough to provide the light required by gating circuit 36. In the preferred embodiment, gating circuit 36 would trigger the triac only at zero crossings; as mentioned before, this contributes to bulb life. A snubber circuit is suggested by the combination 32 of a series capacitor and resistor in parallel with the triac. This again would be part of the typical solid-state switch package, and its purpose would be to prevent dv/dt triggering of triac 34. As is apparent, the solid-state switch 35 is merely exemplary; a wide variety of solid-state switches are commercially available, and ordinary design considerations would determine which type to use.

While it is possible to provide more than two secondary core sections on a magnetic-shunt transformer, only two are shown, since that is the typical number. Windings 18, 20 and 22 are connected to loads not shown. To take advantage of the characteristics of the present invention, these loads would typically be similar to bulbs 30 in that they would draw relatively small currents during most of their operation but would be subject to large-current surges under some conditions.

In operation, AC voltage is applied at terminals 11 and 23, causing AC voltages to be present across windings 14, 18, 20 and 22. If bulbs 30 are to be lighted, voltage is to be applied to terminals 40 and 42, which causes LED 38 to emit light. This enables gating circuit 36 to trigger triac 34 at zero crossings of the voltage across windings 14. If the filaments are cold, bulbs 30 may momentarily tend to draw more than the instantaneous-current rating of switch 35. If this is the case, the secondary core section on which windings 14 and 18 are wound will saturate, allowing the associated alternate flux path to divert flux away from the secondary core section associated with windings 14 and 18. The total current in windings 14 and 18 is thereby kept below a predetermined maximum. As the filaments warm up, they tend to draw less current, so the core returns from saturation, and ordinary operation is resumed.

It is to be noted that the current limiting involves a reduction in voltage at the output terminals of the affected secondaries. Thus, a heavy load on secondary 14 will cause transformer 10 to reduce the voltage across windings 18. Windings 20 and 22, on the other hand, will not be affected. Of course, if it is desired that no loads be unaffected by current limitations on any of the other loads, the designer will want to keep each winding on a separate core section. If the interference with one load by another load is tolerable, however, the embodiment shown in the FIGURE may effect a cost savings.

As is evident from the foregoing description, it is possible, through the use of an embodiment of the present invention, to take advantage of the convenience and zero-crossing switching ability of the solid-state switch on loads subject to high-current surges without requiring the switch to withstand the surge currents and without employing expensive DC supplies.

What is claimed is:

1. A switching and supply circuit for supplying power to a load which operates at a normal current level but is subject to occasional high current surges, the load having first and second sides, comprising:

a. a current limiting transformer having at least one secondary winding with first and second terminals, the first terminal in electrical communication with the first side of the load; and b. a solid-state switch connected in series with the second terminal of the secondary winding and the other side of the load.

2. The apparatus of claim 1, wherein the current-limiting transformer comprises a magnetic-shunt transformer.

3. The apparatus of claim 2, wherein the load comprises an incandescent bulb.

* * * * *